US005661873A

United States Patent [19]

Karet

[11] Patent Number: 5,661,873

[45] Date of Patent: Sep. 2, 1997

[54] ANIMAL WASTE VACUUM WITH DISPOSABLE PICKUP TOOL & DISPOSABLE CONTAINER

[76] Inventor: Ted Michael Karet, 6025 S. Routt St., Littleton, Colo. 80127

[21] Appl. No.: 517,849

[22] Filed: Aug. 22, 1995

[51] Int. Cl.[6] ..... A47L 5/24

[52] U.S. Cl. ..... 15/344; 15/352; 15/353; 15/415.1

[58] Field of Search ..... 15/344, 330, 347, 15/352, 353

[56] References Cited

U.S. PATENT DOCUMENTS

| | | | |
|---|---|---|---|
| 2,598,499 | 5/1952 | Breuer et al. | 15/330 X |
| 2,623,234 | 12/1952 | Brown | 15/330 |
| 3,142,857 | 8/1964 | Fresard et al. | 15/330 X |
| 3,695,006 | 10/1972 | Valbona et al. | 15/347 X |
| 4,185,355 | 1/1980 | Williams | 15/344 |
| 4,288,886 | 9/1981 | Siegler | 15/330 |
| 4,573,234 | 3/1986 | Kochte et al. | 15/344 X |
| 4,663,799 | 5/1987 | Kiyooka | 15/330 |
| 4,956,892 | 9/1990 | Fawkes | 15/344 X |

FOREIGN PATENT DOCUMENTS

| | | | |
|---|---|---|---|
| 155101 | 9/1932 | Switzerland | 15/330 |

*Primary Examiner*—Chris K. Moore

[57] ABSTRACT

The present invention advantageously provides a vacuum system which provides a compact power unit that can accept and pass the full range of expected debris and waste from the pick up robe to the container and which directs the major portion of the exhaust air including entrained dust particles away from the user. The invention discloses disposable pick up tubes and storage containers which are low cost and easy to use which achieve their purposes of picking up, storing and disposing of waste and debris simply and easily.

4 Claims, 8 Drawing Sheets

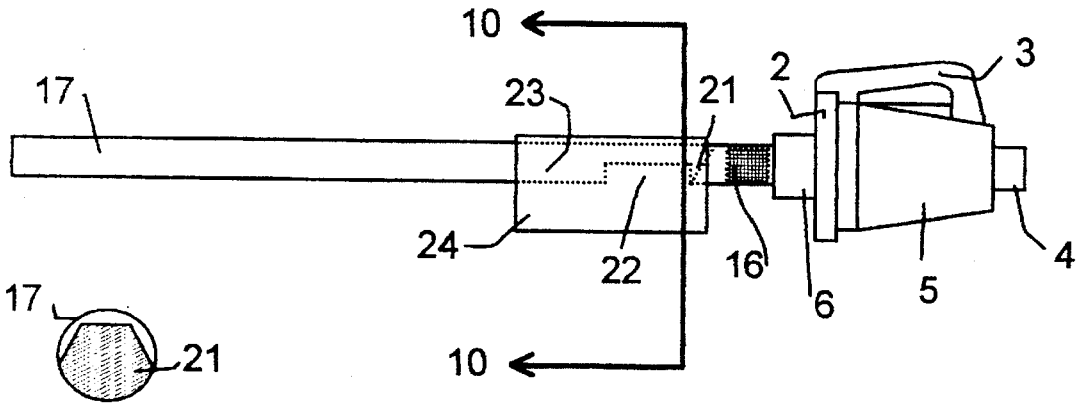
Fig. 11
Fig. 10
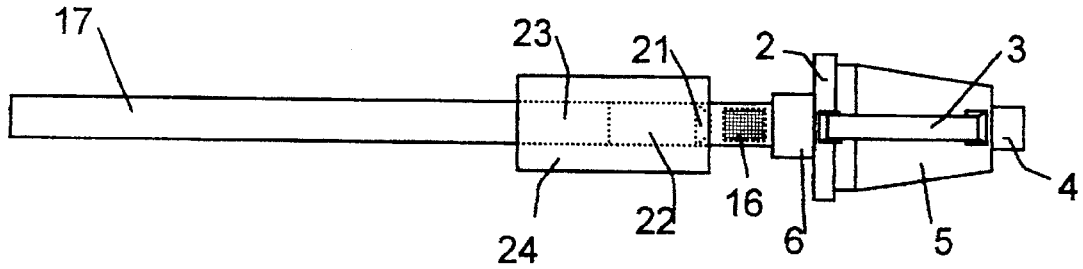
Fig. 12
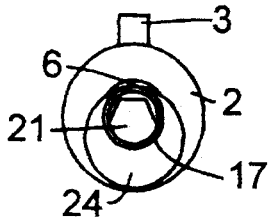
Fig. 13
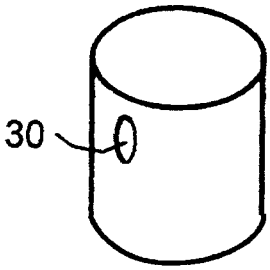
Fig. 28
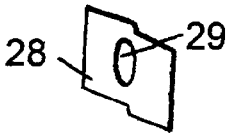
Fig. 27
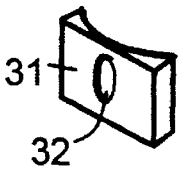
Fig. 29

ANIMAL WASTE VACUUM WITH DISPOSABLE PICKUP TOOL & DISPOSABLE CONTAINER

BACKGROUND OF THE INVENTION

1. The Field of Invention

This invention relates in general to vacuums and animal waste and in particular to vacuums that use a disposable container and pickup tool. The emphasis here is on a potable hand held powered device that uses a vacuum airflow to remove animal waste and in the process collect it in a disposable container which along with the pick up tool can easily be removed from the device and disposed of cleanly with ease.

2. The Description of Related Art

In order to provide background information so that the invention may be completely understood and appreciated in its proper context, reference may be made to a number of prior art patents. Their patent numbers will be listed below when the item is patented. However, there are processes in use which are not necessarily patented whose description and use sheds light on the existing problems of which this new invention solves.

There is a problem for people in using lawn or grassy areas, or sidewalks where animals such as dogs have been. This problem is widespread, especially, but not limited to, dog owners backyards and city streets in crowded metropolitan areas. These animals leave behind their waste. This is particularly obnoxious to people when they are walking, playing or servicing the area and they happen to step in the waste or roll over the waste with the wheels or some other part of their equipment. The problems also extends to health considerations and surface deterioration/discoloration from the natural deterioration of this waste. People have solved this problem by picking up the waste using various tools however each device has its own drawbacks which I will be pointing out, and of which my invention solves.

There is in use a little, garden shovel which is used to scoop up the waste and deposit it in a bucket lined with a disposable bag. But the problems here are stooping or bending repetitively, getting close to the smelly waste, and getting debris on the shovel. My machine is operated from a standing position with no bending or stooping and there is no cleaning of the tools as they are immediately disposed of.

Some dog walkers carry with them plastic baggies which they use to wrap around the waste with their hands, or use a tool to push the waste into. This brings the owner terribly close to the waste and if a tool is used in the process, some waste is left on the tool which must later be cleaned. Not only is this process obnoxious but embarrassing as well as neighbors can see what the owner is carrying. My device keeps the owner at a comfortable distance from the waste and since the waste goes directly into a container no one is embarrassed by onlookers and since the pickup tool and container are disposable there is no cleanup. Just a simple slide out from the machine and a toss into a trash container and they are done.

Another tool is similar to two shovels at the end of long sticks connected midway down the poles as a pair of scissors. This tool keeps the person at a distance from the waste but the problem of bending is replaced with teaming to effectively wield the long handled device to pick up the waste and then dispose of it in another container. But this tool still needs to be cleaned after its use and this is a particularly disgusting task. My hand held machine collects the debris in a long disposable intake lube which is hand controlled for ease of collection and no cleaning is required. All places that come into contact with the debris are disposed of after each use.

Another invention, U.S. Pat. No. 4,549,329, is a vacuum which will intake the debris through a tube. This machine is self cleaning in that after each use it puts down a puddle of water to be vacuumed up and this little mount of water is supposed to dissolve the waste that stuck to the interior of the tube. This device is not as clean as it proposes. The little mount of water that it deposits is not sufficient to clean some waste. It is also a disgusting process in that it must be emptied when filled up and then the waste is more fluid and obnoxious that before. This tool also requires the person to get somewhat close to the smelly obnoxious waste or debris, by stooping or bending to use the tool. My invention, although it used the concept of a long tube as a pickup device is better since it is disposable, and never needs cleaning. It is also better in that the intake tube/container port is easily pointed m and brought near the waste for pickup.

Still another group of tools am the blower/vacuum devices. Please refer to the following U.S. Pat. Nos. 4,325,163, 4,644,606, 4,461,055, 4,870,714 and 5,222,275. These machines are either electric or gas powered blower/vacuums. The blower portion works because an air flow is created with an impeller (fan) connected to the motor/engine, Air is sucked into the machine by the impeller, across the blades of the impeller and pushed out the blower tube. A vacuum is created at the intake end. When the vacuum portion is desired to be used a switch of equipment puts a bag on the blower end and a long tube is put on the intake end. Waste is sucked into the machine via the intake tube, across the impeller and out the blower end and into the bag. However, these types of machines will not work as animal waste vacuums as the waste and debris is smashed and crunched when it rams into the impeller or cut by a mulching blade and this would make a severe mess and clog up the machine. My machine collects the debris before the debris reaches the impeller. The container allows the waste to collect outside of the air flow path and before it gets to the impeller.

There is also another group of portable vacuums, please refer to these U.S. Pat. Nos., 4,325,162, 4,570,286 and 4,944,065 that use a long intake tube and a portable vacuum. These vacuums do not use the combination of disposable pickup tools and disposable storage containers and as pointed out earlier with other devices cleaning these pieces of equipment after each use would be problematic.

Whatever the precise merits, features and advantages of the above cited references, none of them achieves or fulfills the purposes of the current disposable intake tube and container of the present invention.

SUMMARY OF THE INVENTION

Accordingly, it is a principal object of the present invention to provide a vacuum operated device and tool with characteristics that will enable the user to pick up waste and debris with less bending and less stooping.

It is also another principal object of the present invention to provide a vacuum operated device with a disposable intake tube and disposable container which connects and disconnects easily to the vacuum source.

It is also another principal object of the present invention to provide a vacuum operated device with a disposable intake tube and disposable container which are made and marketed at a very low cost so as to allow the user to dispose of the tube and container after each use.

It is another principal object of the present invention to provide a vacuum device with a disposable pick up tube and disposable storage container which are used to pick up noxious waste and debris and be more recyclable, more biodegradable, easier to dispose of, and more environmentally friendly than existing tools or methods.

It is another principal object of the present invention to provide a way to pick up waste and debris using a vacuum source with a disposable intake tube and container in which it is believed that the air pressure in the container portion of the device is sufficiently less then the air pressure in the other portions of the device so as to create an air pressure drop which allows other forces to act on the waste and thereby directing the movement of the waste.

It is another principal object of the present invention to provide a vacuum device with a disposable pick up lube and disposable storage container that will pick up waste and debris in a much cleaner and less noxious manner and allow disposal to be quicker and easier than with existing methods.

Still another principal object of the present invention is to provide a vacuum device with a disposable pick up tube and disposable storage container that is comfortable and easy to use so that the user simply walks around the area to be cleaned and by simple hand motions points the tip of the pick up tool at base of the waste and the waste is sucked up into and through the pick up tool and stored in either container or in the pick up tool itself depending upon the version the user has chosen to use.

Still another principal object of the present invention is to provide a vacuum device with a disposable pick up tube and disposable storage container which is portable and can be operated on its own self-contained power supply or can be plugged into a conventional electrical outlet.

Still another principal object of the present invention is to provide a vacuum device with a disposable pick up tube and disposable storage container having the aforementioned described advantageous objects which is lightweight and simple in construction, easy to use and maintain and can be made and sold at a reasonable cost.

Still another principal object of the present invention is to provide a superior vacuum device with a disposable pick up tube and disposable storage container that is both lighter in weight and more convenient to use and which functions in a more efficient manner for picking up animal waste and debris than any previous art.

Still another principal object of the present invention is to provide a vacuum device with a disposable pick up tube and disposable storage container in which the debris and waste are efficiently captured while directing the major portion of the exhaust air flow, and any entrained particles away from the user.

Still another principal object of the present invention is to provide a vacuum device with a disposable pick up tube and disposable storage container having sufficient power and light weight to provide a system well-suited for its intended use.

Still another principal object of the present invention is to provide a vacuum device with a disposable pick up tube and disposable storage container where the volume of the container, it is believed, is large enough compared to the intake tube and while considering the force of the vacuum to allow sufficient pressure drop in said container to allow the incoming debris and waste to be directed into and stored in said container.

Still another principal object of the present invention is to provide a vacuum device with a disposable pick up tube and disposable storage container whose pick up tool is sufficiently large enough to pick up animal waste and debris.

The invention is a hand held portable vacuum with at least three different configurations and all are specially designed with low cost intake tubes and containers which are intended to be disposed of after each and every use and they are designed to be used for the purpose of cleanly and easily picking up animal waste and other debris. The vacuum is sourced from a fan connected to but not limited to an electric motor, or an internal combustion engine which produces a sufficient amount of vacuum to draw the waste from its location through the pick up tube and into the storage container. The pick up tube is constructed from a suitable material whose characteristics meet the needs as intended and the material is to be either recyclable or biodegradable and environmentally friendly.

The present invention advantageously provides a vacuum system which provides a compact power unit that can accept and pass the full range of expected debris and waste from the pick up tube to the container and which directs the major portion of the exhaust air including entrained dust particles away from the user. Other objects and further scope of applicability of the present invention will become apparent from the detailed description to follow, taken in conjunction with the accompanying drawings in which like parts are designated by like reference characters.

BRIEF DESCRIPTION OF THE DRAWING

FIG. 10 is a side elevational view of the complete unit of Version B of the present invention;

FIG. 11 is an enlarged detail representative view taken along line 10—10 of the stopper of FIG. 10;

FIG. 12 is a top elevational view of the complete unit of Version B of the present invention;

FIG. 13 is a from elevational view of the complete unit of Version B of the present invention;

FIG. 27 is a perspective view of a representative flexible sheet.

FIG. 28 is a perspective view of the storage container and the inlet hole for an alternate embodiment using the flexible sheet.

FIG. 29 is a perspective view of a representative sturdy cover to secure the flexible sheet to the storage container in the flexible sheet embodiment.

DETAILED DESCRIPTION

Figure 1:
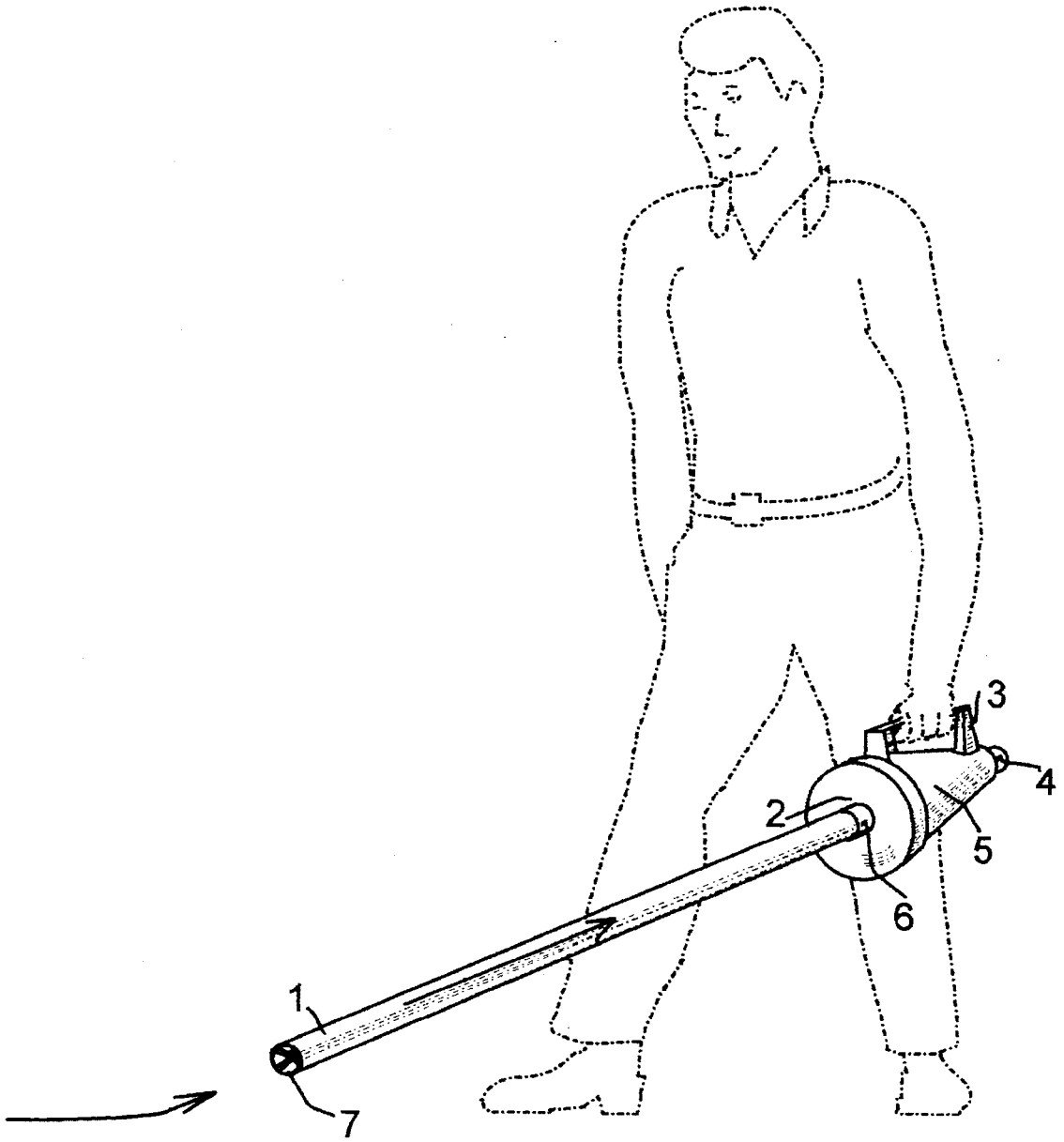
FIG. 1 is a perspective view of the complete unit of Version A of the present invention.
Figure 5:
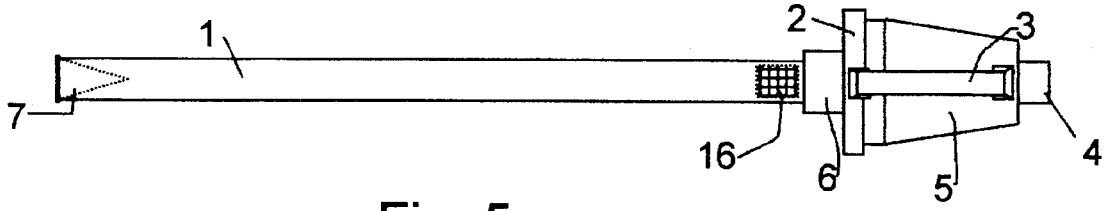
FIG. 5 is a top elevational view of the complete unit of Version A of the present invention.
Figure 6:
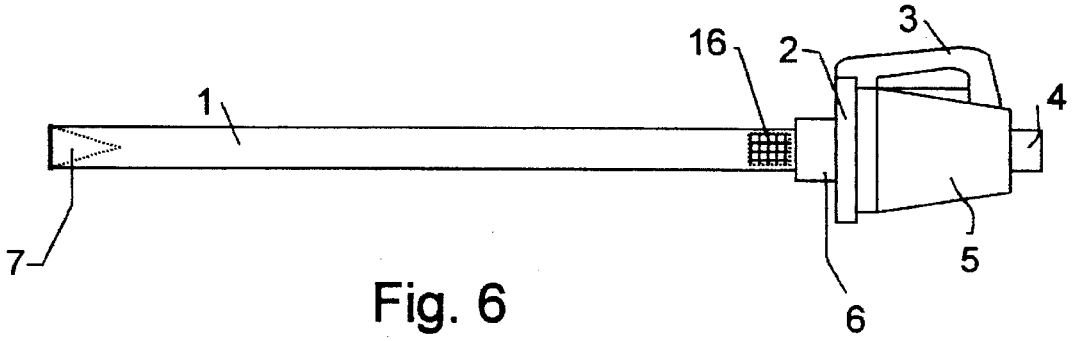
FIG. 6 is a side elevational view of the complete unit of Version A of the present invention.
Figure 8:
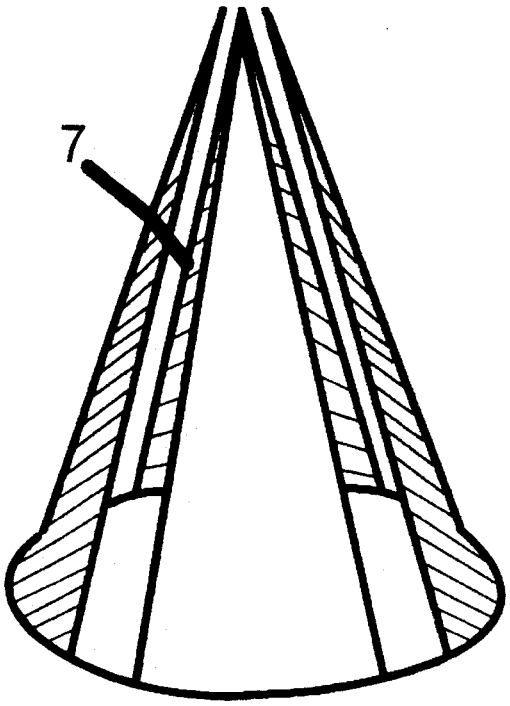
FIG. 8 is an enlarged detail perspective view of the keeper device, item #7, of the present invention.
Figure 7:
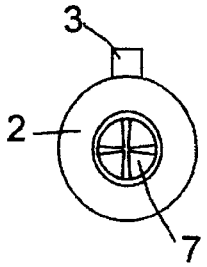
FIG. 7 is a front elevational view of the complete unit of Version A of the present invention.
Figure 9:
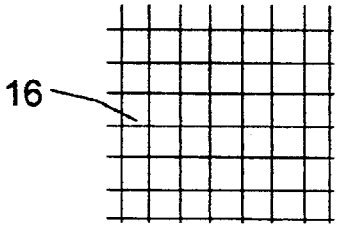
FIG. 9 is a representative view of the weave of the high porosity mesh suitable for use as item #16 of the present invention.
Figure 14:
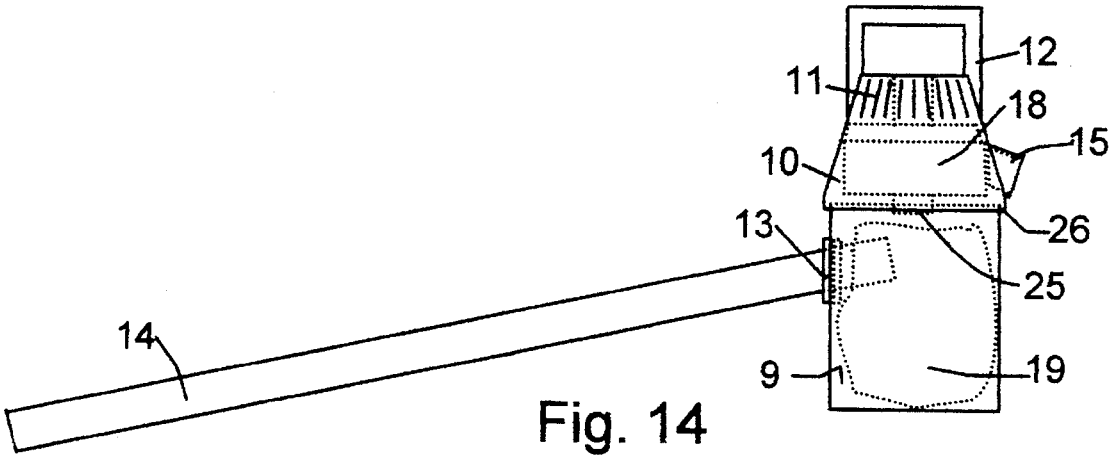
FIG. 14 is a side elevational view of the complete unit of the vacuum configuration of Version C of the present invention.
Figure 15:
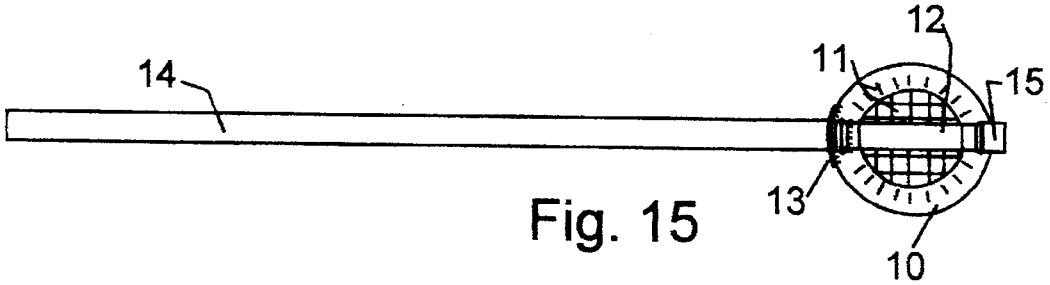
FIG. 15 is a top elevational view of the complete unit of the vacuum configuration of Version C of the present invention.
Figure 16:
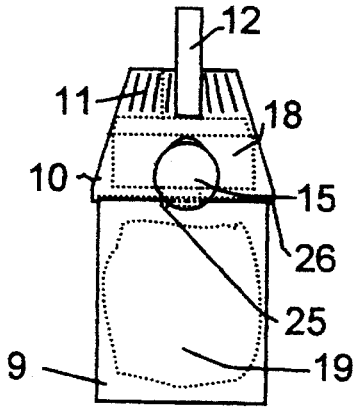
FIG. 16 is a back elevational view of the complete unit of the vacuum configuration of Version C of the present invention.
Figure 17:
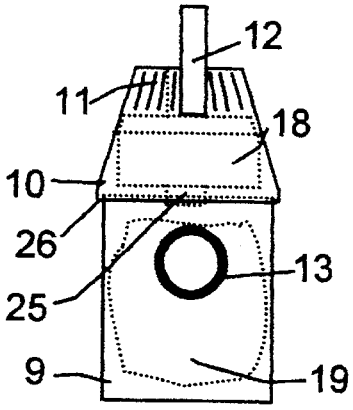
FIG. 17 is a front elevational view of the complete unit of the vacuum configuration of Version C of the present invention.
Figure 18:
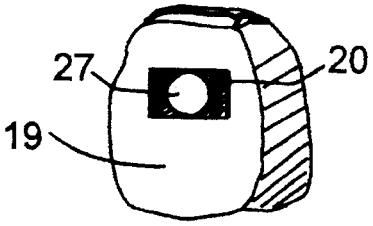
FIG. 18 is a perspective view of the debris collecting bag, #19 used in the vacuum configuration of Version C of the present invention.
Figure 19:
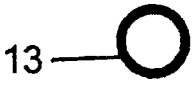
FIG. 19 is a front view of the rubber grommet, #13, used in Version C of the present invention.
Figure 20:
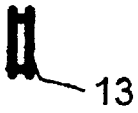
FIG. 20 is a side view of the rubber grommet, #13, used in Version C of the present invention.
Figure 21:
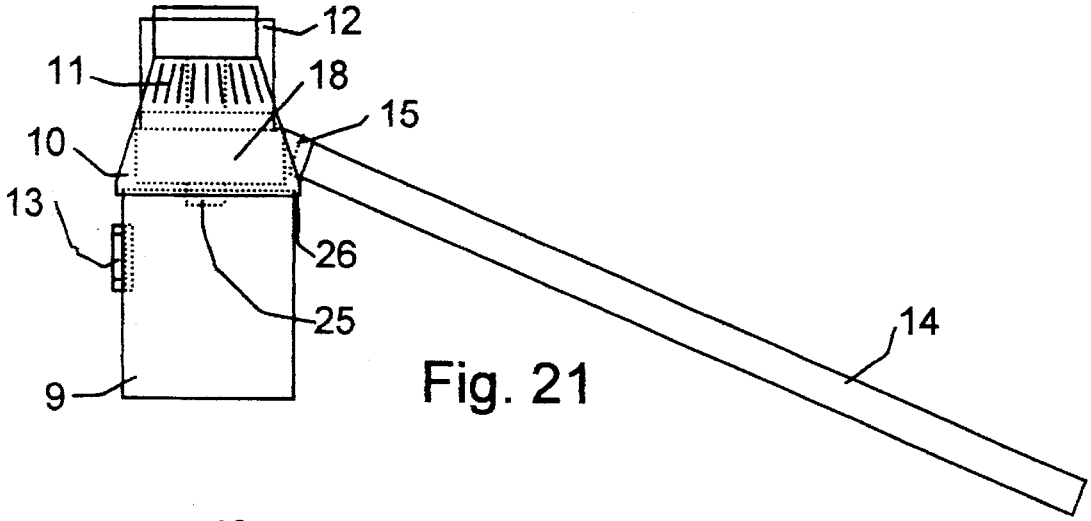
FIG. 21 is a side elevational view of the complete unit of the blower configuration of Version C of the present invention.
Figure 22:
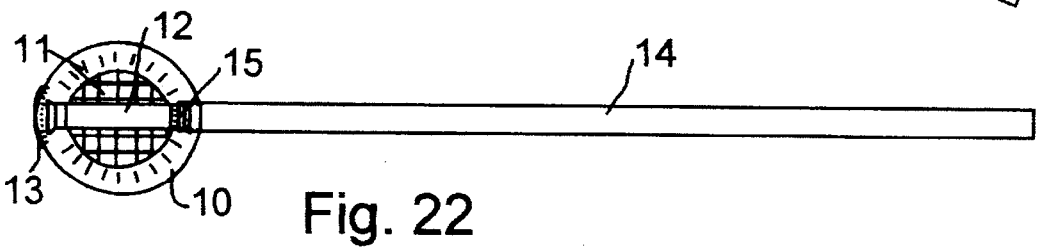
FIG. 22 is a top elevational view of the complete unit of the blower configuration of Version C of the present invention.
Figure 23:
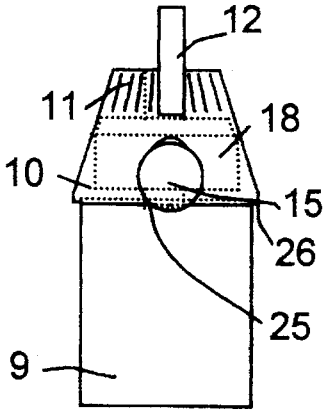
FIG. 23 is a front elevational view of the complete unit of the blower configuration of Version C of the present invention.
Figure 24:
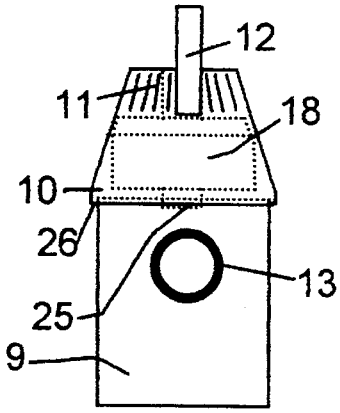
FIG. 24 is a rear elevational view of the complete unit of the blower configuration of Version C of the present invention.
Figure 25:
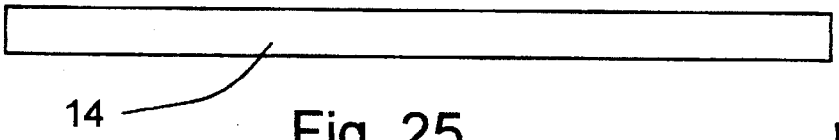
FIG. 25 is a side elevational view of the pick up tube used in Version C of the present invention.
Figure 26:
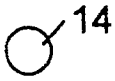
FIG. 26 is and end view of the pick up tube used in Version C of the present invention.

In view of the above mentioned objects and others, refer now to FIG. 1 for an overall drawing of one of the preferred embodiments of the invention, Version A. This version of the present invention, as dram in farther detail in FIGS. 5, 6 and 7, comprises a vacuum device having a power unit 5 with a rotatably mounted fan 2 of for inducing an air flow from an inlet 6 to an outlet 4. The unit is guided and directed by using the hand held handle 3. The pick up tube 1 of this vacuum device having sufficient diameter relative to the waste and debris to be picked up is connected to the vacuum source by simply slipping it into the inlet 6 of the power unit 5 which pulls the debris into and along the pick up tube 1. The pick up tool of Version A comprises a tube open at both ends with the exception of a keeper device 7 at the pick up end and a filtering device 16 at the air flow exit end. This keeper device 7 comprises a plastic ring that attaches to the end of the tube and this plastic ring has approximately 4 long finger-like tabs which come close together at a point just inside the end of the pick up tube. These tabs are made of a suitable material, such as a light weight plastic, that allows them to flex from their base to open at their tips to permit the waste and debris to pass and then close afterward to keep any waste or debris from passing through in the reverse direction. There is sufficient space between these tabs to allow a sufficient amount of vacuum to pass by the edges of these tabs to pick up the intended waste and debris and pull it into the tube 1 and continue moving the waste and debris through these tabs as the tabs flex open but not so much space between the tabs that any of the intended waste and debris may pass through the tabs when they are closed. In another embodiment this keeper device 7 is an integral part of the pick up tube 1. In this alternate embodiment the flexible tabs will still flex open and closed as waste and debris passes through, however they will be constructed as a continuation of the pick up tube end and they will be bent and inserted into the interior of the pick up tube. This embodiment works well if constructed using a cardboard tube. The filtering device 16 at the air flow exit end of the pick up tube 1 is designed in such a way that it will stop the intended waste and debris from passing any farther and entrap it in the tube 1 while allowing the air flow caused by the vacuum created by the motor 5 and fan 2 to continue and pass through the motor and fan to the outside. This Version A is designed to store the amount of waste picked up in one use and then it is intended to be disposed of. The pick up tube 1 and its components are made of recylable or biodegradable materials, such as plastic, paper or cardboard, and are environmentally friendly so that the daily use of these items will not cause an environmental hazard. This Version A of the present invention in intended to pick up a small mount of waste and debris and it's recommended use is for people to take with them when they take their pets for a walk. Version B and Version C are intended for uses where larger amounts of waste will need to be picked up.

Figure 2:
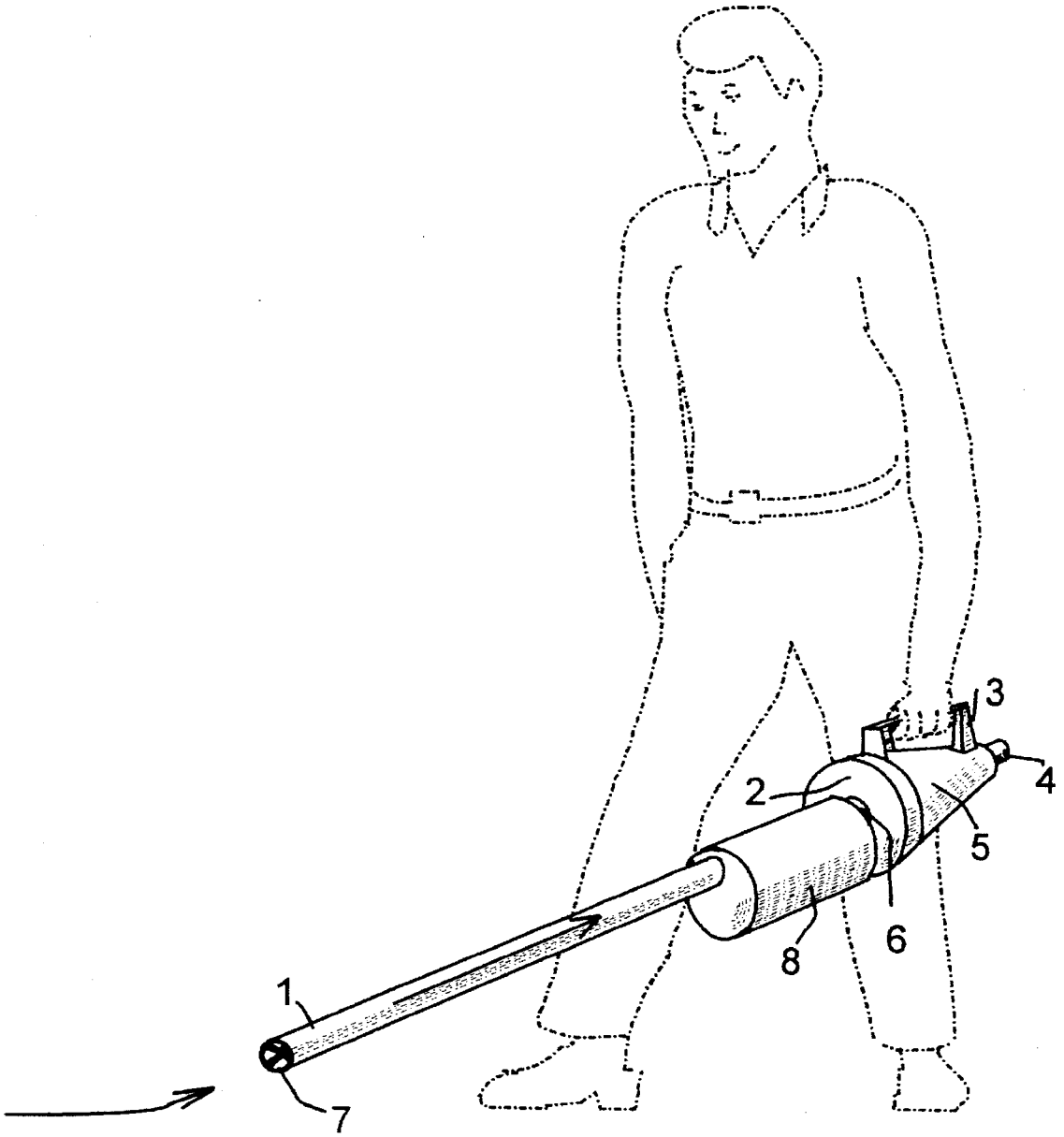
FIG. 2 is a perspective view of the complete unit of Version B of the present invention.

Refer now to FIG. 2 for an overall drawing of another of the preferred embodiments of the invention, Version B. This version of the present invention, as drawn in further detail in Figs. 10, 12 & 13, comprises a vacuum device having a power unit 5 with a rotatably mounted fan 2 for inducing an air flow from an inlet 6 to an outlet 4. The pick up tube 17 of this vacuum device having sufficient diameter relative to the waste and debris to be picked up opens into and passes through the storage container 24 and is connected to the inlet 6 of the power unit which pulls the debris through the pick up tube 17 and into the storage container 24. The section of the pick up tool which passes through the storage container 24 comprises a cut out of most of the lower portion of the back half section of said tube 22 and a deflector tab 21 as seen in FIG. 11. Both the cutout 22 and the deflector tab 21 are sufficiently sized to accept and direct the expected range of waste and debris. There is also a filtering stopper device 16 which completely filters the air as is passes around the deflector 21 and through the remaining tail section of the pick up tube 17 and into the fan 2 and motor section 5. The debris passes through the intake tube 17 being carried by the vacuum air flow caused by the motor 5 and fan unit 2 until it hits the deflector 21 as seen in FIG. 11, at which time, it is believed, because of the lower air pressure in this section and the interruption in the inertia of the waste and debris the gravitation force of the earth pulls the waste and debris through the opening in the intake tube 22 and into the storage container 24. The remaining portion of the portion of the intake tube 23 which passes through the storage container, this is the first portion that is inside the storage container, keeps the waste and debris that has already been picked up from going back into the incoming pathway. Any smaller particles that bypass this container section are caught by the filter 16 in the tail section of the pick up tube 17. It is in the enlarged container space 24 of Version B that a larger amount of waste and debris can be collected. A typical place where this version would be used is in cleaning up a pet owners backyard.

Figure 3:
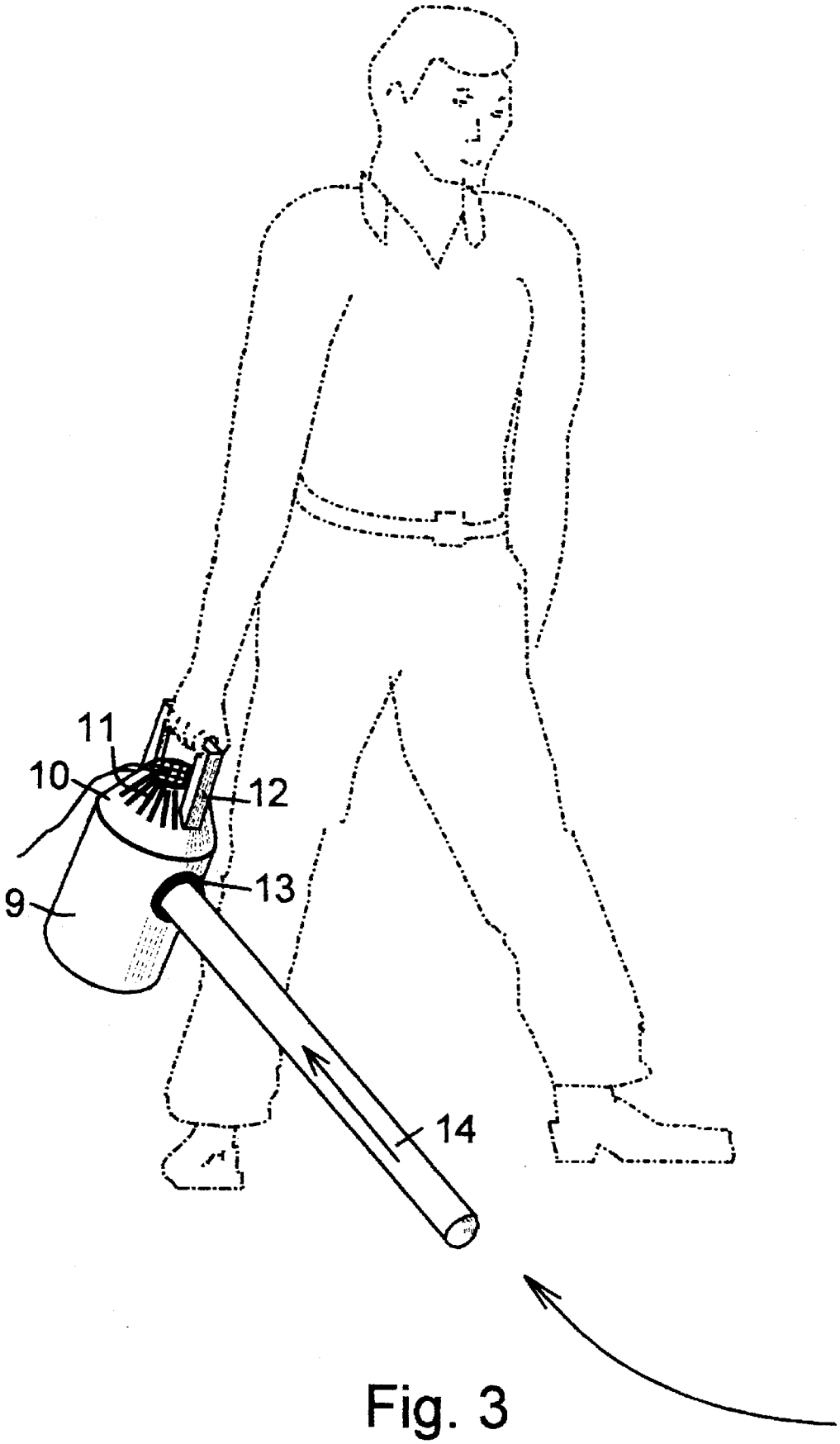
FIG. 3 is a perspective view of the complete unit of the vacuum version of Version C of the present invention.
Figure 4:
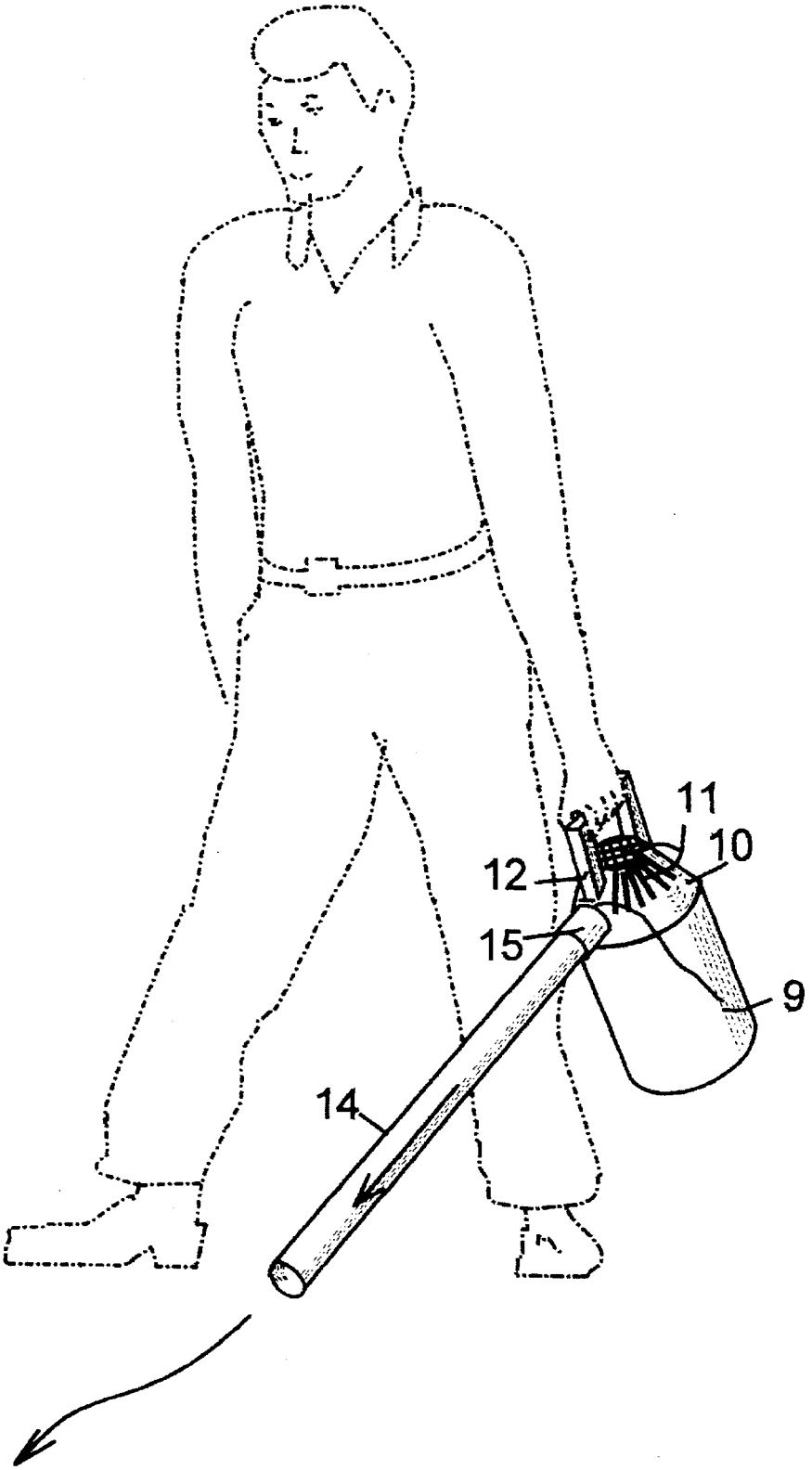
FIG. 4 is a perspective view of the complete unit of the blower version of Version C of the present invention.

Refer now to FIGS. 3 and 4 for two overall drawings of another of the preferred embodiments of the invention, Version C. This version of the present invention, as drawn in further detail in FIGS. 14, 15, 16 and 17 for the vacuum function and FIGS. 21, 22, 23 and 24 for the blower function. Both functions are created using a power unit 18 with a rotatably mounted fan 18 for inducing an air flow from an inlet 25 to an outlet 15. Said motor is cooled by air brought in through the openings 11. The inlet 25 is the source of the vacuum and the outlet 15 is the source for the blower. This power unit housing 10 easily mounts on top of the storage container 9 and has the means for locking in place by pressing the flange 26 of the base of the housing 10, to which the motor 18 and fan 18 are mounted to, onto and around the lip of the open top of the storage container 9 or any arrangement whereby the motor base and open portion of the container have the means for a lockable connection and an airtight seal. The pick up tube 14 for the vacuum function, FIGS. 14, 15, 16 and 17, having sufficient diameter relative to the waste and debris to be picked up is inserted into and through the upper side wall of the storage container 9 via a rubber grommet 13 which creates an airtight seal between the container 9 and the pick up tube 14. This storage container 9 may or may not have, at the discretion of the operator, a sealed flexible wailed storage filtering bag 19. This bag will fit neatly inside the storage container 9 and will have an opening to accept the intake tube 14. The opening of this filtering bag 27 is of sufficient size to accept the intake tube 14 and seal around the exterior of the tube and is reinforced at the opening with a more rigid support 10. This bag 19 is of sufficient porosity so as to entrap the expected range of waste and debris and still allow a sufficient amount of air flow through the porous walls, into the solid walled container 9 and out through the opening 25 which leads to the intake of the fan 18 and motor 18. The storage container 9 is connected to the power unit 18 which generates a vacuum which pulls the debris through the pick up tube 14 and into the storage container 9 and if so desired by the operator, into the bag 19. In an alternate construction, the rubber grommet 13 may be replaced with another setup, FIG. 27, comprising a flexible sheet, 18 with a hole in it's center 29. This hole 19 in the flexible sheet 28, is aligned over the hole 30 in the storage container, FIG. 28, in such a manner as to allow the end of the pick up tube 14 to pass through the flexible sheet 28 and into the storage container 9 while making an airtight seal between the pick up tube 14 and the storage container 9. This flexible sheet 28 is held in place by a sturdy cover 31, FIG. 29 which also has a similarly sized hole 32 in it's center. This sturdy cover 31 with it's centered hole 32 is also aligned over the two other holes 29 and 30 and also allows the pick up tube 14 to pass through it as well. This sturdy cover 31 is held in place and holds the flexible sheet 28 in place by suitable means. Still in another embodiment the sealed flexible walled storage filtering bag 19, may be replaced with the same bag and opening and support but have an opened top, or in yet another embodiment this bag may be any type of open top bag so as to allow the waste to fall into the bag and the air to flow to the vacuum intake 15. However, in such an embodiment as this, an air filter located inside the opening at the vacuum intake 15 will be necessary to entrap any remaining airborne waste. It is believed that the porousness of the bag becomes obsolete once the top is opened as the air flow would not longer be restricted.

For the blower function of Version C, FIGS. 21, 22, 23 and 24, the pick up tube 14 is removed from the rubber grommet 13 and is inserted into the fitting 15 for the exhaust air and directs the exhaust air through the end of the tube 14. This tube 14 in this position is now called the discharge tube 14.

The handle 12 is aligned in the same plane as the pick up tube or the discharge tube. This alignment aids the user in aiming the pick up tube for either function. The foregoing descriptions of these preferred embodiments of the invention has been presented for the purposes of illustration and description. It is not intended to be exhaustive or to limit the invention to the precise forms disclosed. Many modifications and variations are possible in light of the above teaching. It is intended that the scope of the invention be limited not by this detailed description, but rather by the claims appended hereto.

What is claimed is:

1. A vacuum system comprising:

a motor fan unit having a fan rotatably mounted in a fan scroll for drawing air from an inlet and for exhausting the air to an outlet; a pick up tube having a first opening at one end and a second opening at the other end, said openings being located in planes substantially perpendicular to the longitudinal axis of said pick up tube; a stiff thin walled container with an open top and closed bottom and a hole in the wall of said container whose center is at approximately a distance of the diameter of the pick up tube from the edge of the open top so that the edge of the opening is located near the upper edge of the open top of the container and said hole is of sufficient diameter to accept and secure a rubber grommet with an inside diameter just smaller than that of the pick up tube; a rubber grommet with an inside diameter of just smaller than the pick up tube used as a means for attaching and creating an airtight seat between the container and the pick up tube and yet allow for the repetitive insertion and removal of the pick up tube through the grommet and into the container; a mounting cowl and motor housing that has means for supporting the motor fan unit and is constructed of a suitable material so as to be pressed onto and removed by hand from the open lip of the aforementioned container producing an airtight seal and a secure attachment when attached and an easy separation by hand when needed to be separated for various purposes including emptying the container; a filtering device of suitable size and volume and mesh that allows the sufficient amount of airflow to pass and yet keep any small particles of the intended waste and debris entrapped, said filtering device spans the inlet to the fan motor housing and is kept in place by friction between itself and the walls of the inlet housing and a plastic filter gate; a plastic filter gate located between the aforementioned filtering device and the fan at the inlet of the motor fan unit being a permanent integral part of the inlet.

2. A pick up tube as in claim 1 which is of little expense so as to be disposed of after each use.

3. The vacuum system of claim 1, wherein: said pickup tube has a length of approximately 38 inches.

4. The vacuum system of claim 1, wherein: said pick up tube has an inside diameter of approximately 2".

* * * * *